US005684257A

United States Patent [19]

Yanagisawa

[11] Patent Number: 5,684,257

[45] Date of Patent: Nov. 4, 1997

[54] SNARE DRUM STRAINER

[75] Inventor: Mitsuo Yanagisawa, Chiba, Japan

[73] Assignee: Pearl Musical Instrument Co., Chiba, Japan

[21] Appl. No.: 569,476

[22] Filed: Dec. 8, 1995

[51] Int. Cl.[6] ..... G10D 13/02

[52] U.S. Cl. ..... 84/415

[58] Field of Search ..... 84/415, 416, 417

[56] References Cited

U.S. PATENT DOCUMENTS

| | | | |
|---|---|---|---|
| 399,396 | 3/1889 | Fry | 84/415 |
| 1,354,028 | 9/1920 | Danly | 84/415 |
| 1,446,327 | 2/1923 | Baldwin et al. | 84/415 |
| 2,517,144 | 8/1950 | Strupe | 84/415 |
| 2,621,554 | 9/1952 | Way | 84/415 |
| 3,635,119 | 1/1972 | Thompson | 84/411 |
| 4,138,920 | 2/1979 | Meador | 84/415 |
| 4,203,343 | 5/1980 | Bargeman | 84/415 |
| 4,246,825 | 1/1981 | Hodas | 84/415 |
| 4,339,982 | 7/1982 | Hoshino | 84/415 |
| 4,383,467 | 5/1983 | Glassford, Jr. | 84/415 |
| 4,967,634 | 11/1990 | Whynott | 84/413 |
| 5,107,742 | 4/1992 | Cummings et al. | 84/415 |
| 5,275,081 | 1/1994 | Freer | 84/415 |

OTHER PUBLICATIONS

Ludwig Advertisement of 1941 "The Swing Drummers' Manual" pp. 4–6.

*Primary Examiner*—Michael L. Gellner
*Assistant Examiner*—Shih-yung Hsieh
*Attorney, Agent, or Firm*—Longacre & White

[57] ABSTRACT

An improved strainer that has click stops in between the fully on and fully off settings allowing the artist to instantly change the tension of the snares by simply moving the lever to the desired click stop. Without having to manipulate the cumbersome tension knob, the artist is free to instantly choose between relatively loose, medium and tight settings of the snares.

12 Claims, 4 Drawing Sheets

SNARE DRUM STRAINER

BACKGROUND OF THE INVENTION

1. Field of the Invention

The present invention relates to a snare drum strainer, and more particularly to an adjustable strainer capable of quickly adjusting and locking the strainer during performance.

2. Description of the Prior Art

The snares of a snare drum comprise a number of sound wires, (Snares) which contact the bottom drumhead of a snare drum and are vibrated by the vibration of the drum head to generate additional noise. It is often desirous to change the tension in the snares to change the snare action or response of the vibrating snares. It is also desirous to shift the snares so that they no longer contact the surface of the bottom of the drum head to produce a more conventional drum sound. Numerous patents disclose various methods to change the tension in the snares.

U.S. Pat. No. 4,339,982 discloses an apparatus for moving snares toward and away from the bottom of the snare head surface and is incorporated herein by reference. A bracket is attached to the side of the drum which rotatably supports a lever. The lever is rotated to cause a slider to move toward or away from the bottom drum head surface. The snares are attached to the slider so that when the lever is rotated the snares either engage or disengage the bottom surface of the drum head. In order to adjust the tension of the snares an adjustment screw is simply turned in one direction or the other to increase or decrease the tension.

U.S. Pat. No. 5,107,742 discloses a shiftable snare drum strainer and is incorporated herein by reference. A snare is attached to a slide which is longitudinally and slidably supported on the side of the drum's surface. When the snares are to be disengaged, the slide is simply pushed downward and locked so that the snares do no touch the bottom surface of the drum head. When the snares are to engaged the drum head surface a release pad is depressed unlocking the slide. The slide is biased upward to cause the snares to engage the drum.

U.S. Pat. No. 4,383,467 discloses a device to adjust the tension in drum snares and is incorporated herein by reference. A lever and roller assembly are attached to the side of the drum so that depression of the lever causes an increase in the tension in the snares. When the desired tension is achieved a clamp screw is tightened to lock the lever in the desired position.

In order to adjust the tension of the snares of the prior art the tensioning device must first be unlocked before adjustment can be made. Once the desired tension in the snares is achieved the device must then again be locked. Additionally, the prior art does not provide a tensioning device to quickly adjust the device to a plurality of predetermined intermediate positions. Thus, prior art strainer devices are cumbersome and difficult to manipulate while playing the drum.

SUMMARY OF THE INVENTION

The primary object of this invention is to provide a snare drum strainer to permit a drummer to change the tension in the snares in one simple operation without having to unlock and relock the tensioning device.

It is another object of the invention to provide a snare drum strainer with a tensioning device which is adjustable to a plurality of predetermined positions.

It is another object of the invention to provide a drum strainer which indicates to the drummer that a desired tension has been achieved.

The device includes a bracket for securing the strainer to the side of a drum shell. A lever is rotatably supported by the bracket to engage a slider. The slider is vertically and slidably supported by the bracket and is attached to the drum snares. When the lever is rotated the slider is moved away from the bottom surface of the drum head and the snares are thus tightened. A tension knob and tension bolt are provided to adjust the length of the slider to enable fine adjustment of the tension in the snares. A stylus, for engaging a recess, is attached to the lever such that it travels in an arc when the lever is rotated. A backing plate is secured to the side of the drum shell and has a plurality of recesses arranged in an arc corresponding to the arc in which the stylus travels. The stylus is equipped with a spring biased ball bearing so as to contact the surface of the backing plate as the lever is rotated. When the stylus aligns with one of the recesses of the backplate the ball bearing is biased to engage the recess and a faint clicking noise is generated indicating to the drummer that the lever is secure.

With the design of the invention, a musician may easily manipulate the drum strainer to achieve a variety of drum sounds. These and other advantages will become apparent in the following description and with reference to the following drawings.

DESCRIPTION OF THE PREFERRED EMBODIMENT

Figure 2:
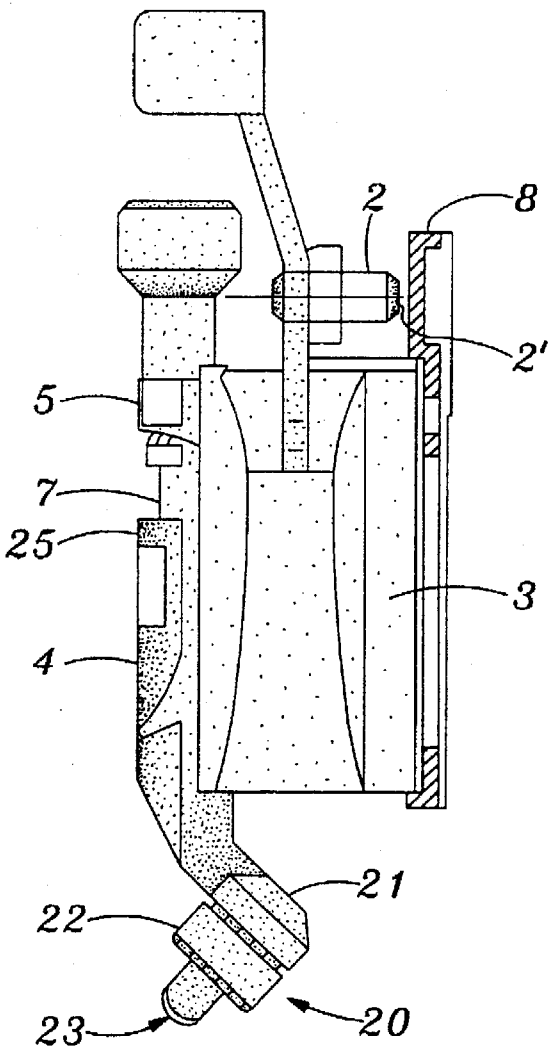
FIG. 2 is an elevated side view of the strainer assembly.
Figure 1:
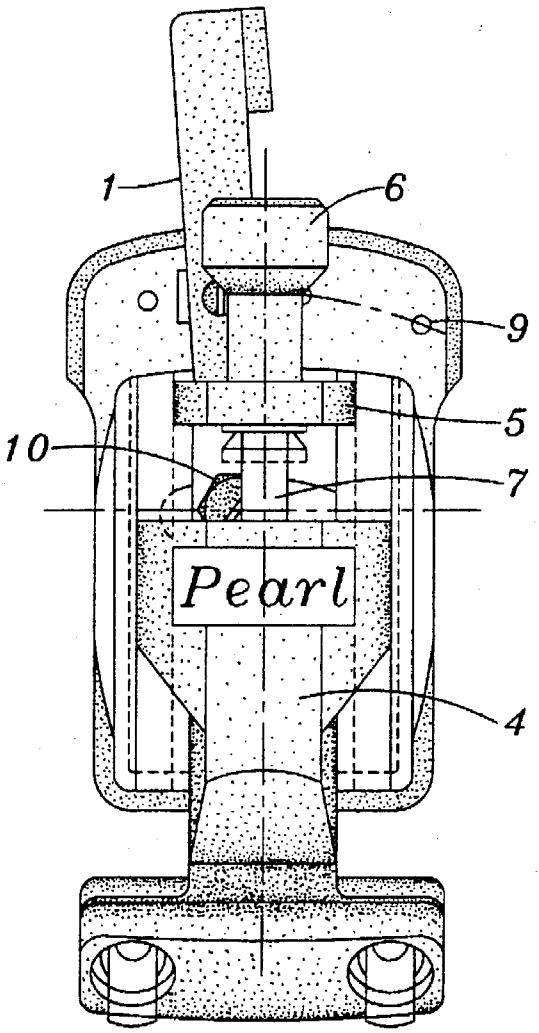
FIG. 1 is an elevated front view of the strainer assembly.
Figure 3:
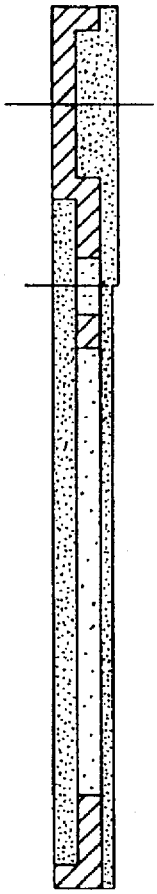
FIG. 3 is a side view of the backing plate.
Figure 4:
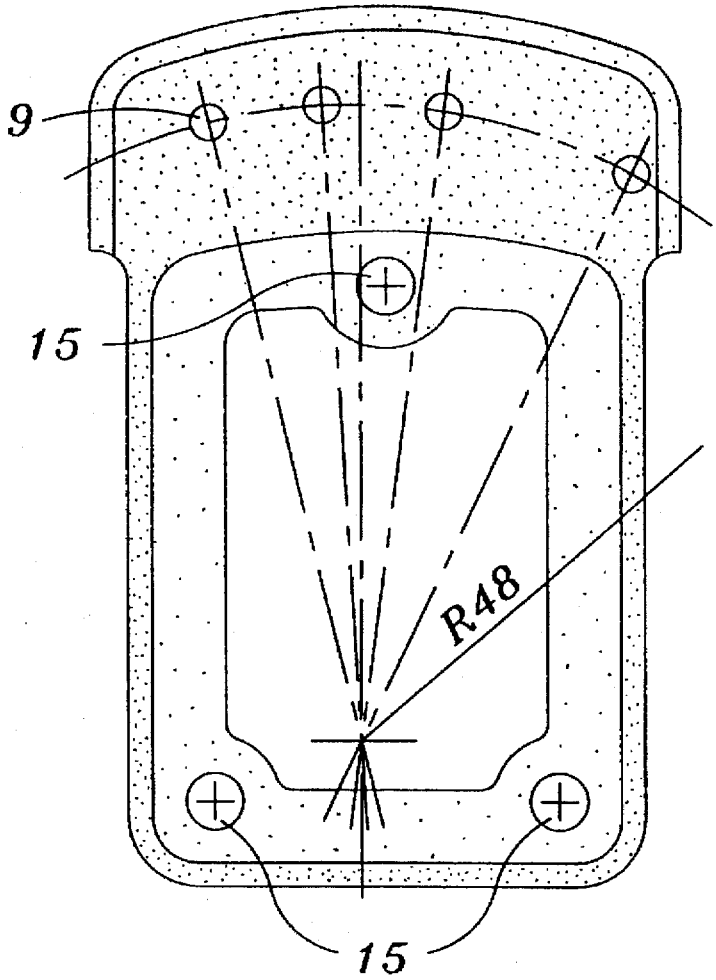
FIG. 4 is an elevated exposed front view of the backing plate.
Figure 5:
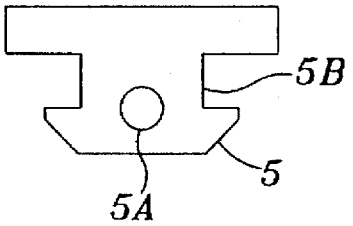
FIG. 5 is an exposed top view of the upper slider member.
Figure 6:
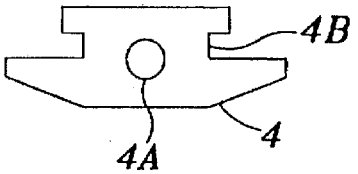
FIG. 6 is an exposed top view of the lower slider member.
Figure 7:
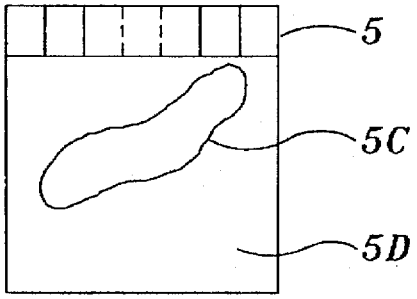
FIG. 7 is an exposed front view of the upper slider member.
Figure 8:
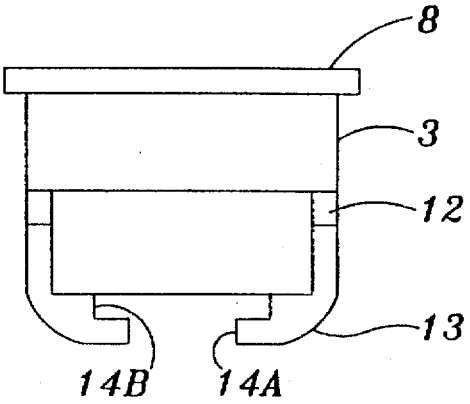
FIG. 8 is a top view of the backing plate and bracket.
Figure 10:
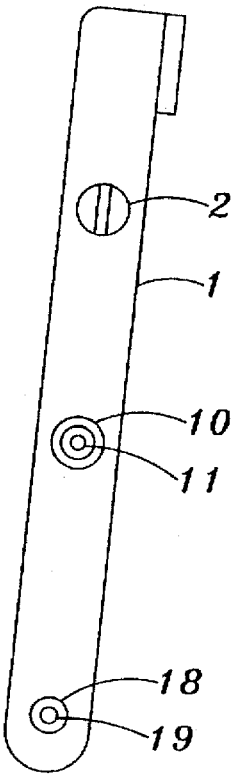
FIG. 10 is a front exposed view of the lever.
Figure 9:
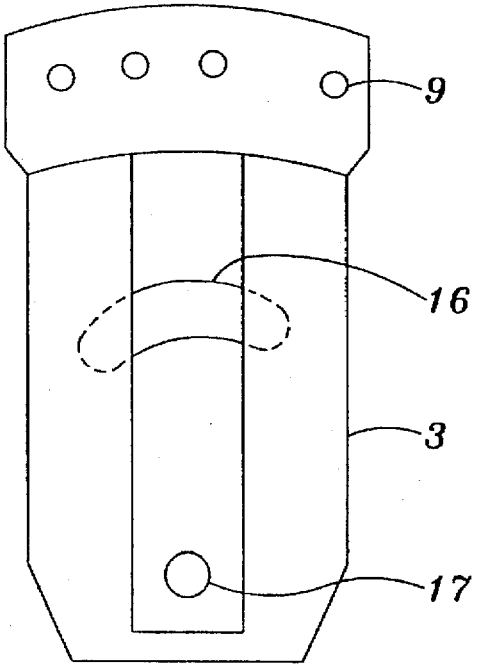
FIG. 9 is a front view of the backing plate and bracket.
Figure 11:
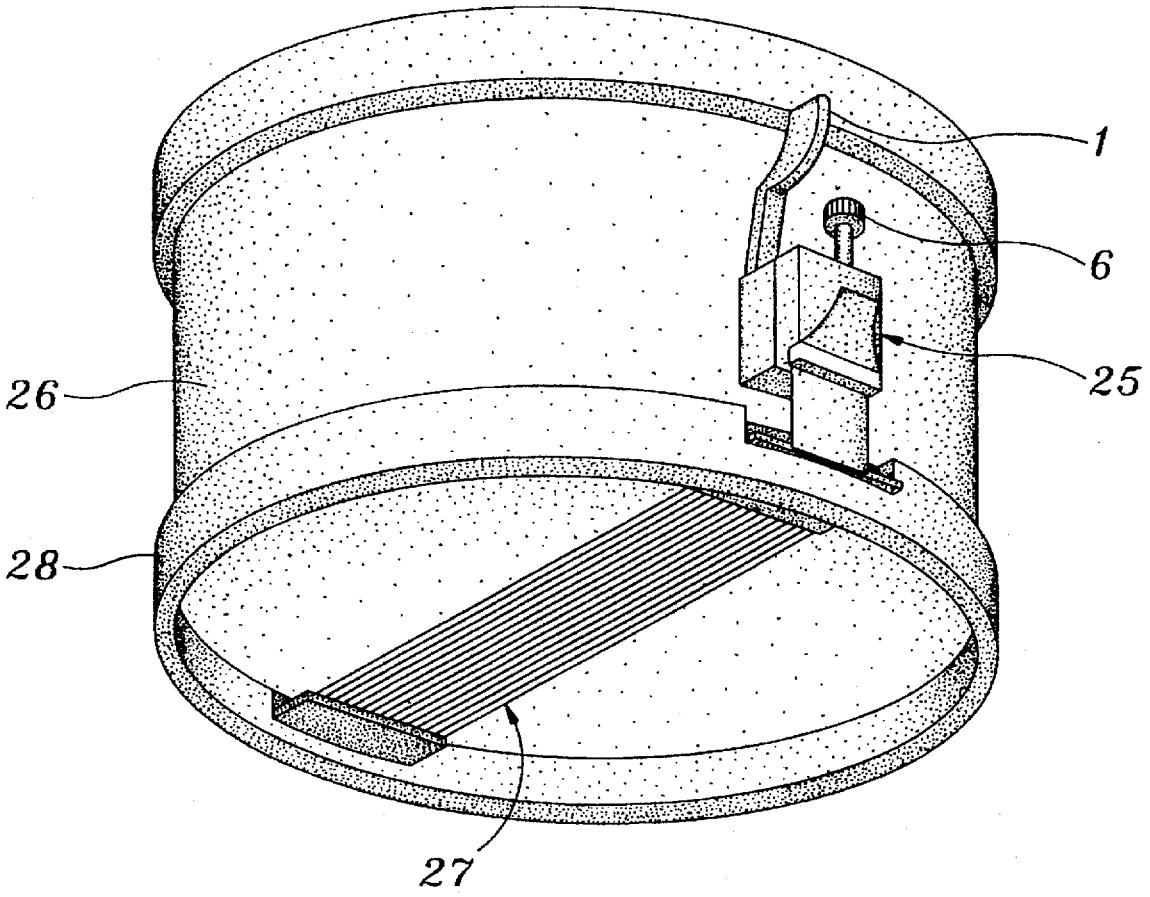
FIG. 11 is an oblique, bottom, perspective view of an alternate embodiment of the strainer assembly mounted to the side surface of a snare drum.

A drum snare strainer according to the invention is shown generally in FIG. 1 and FIG. 2. The strainer is attached to the side of a snare drum 26. The drum strainer comprises a backing plate 8, bracket 3, slider assembly 25 and lever 1. Backing plate 8 has several holes 15 to allow screws or bolts to pass through in order to be secured to the side of a snare drum. Bracket 3 has several bores corresponding to the holes in the backing plate to threadably receive the screws or bolts. The bolts or screws extend from the side surface of the snare drum 26 through holes 15 and threadably engage the bores in the bracket. The bolts or screws serve the dual purpose of securing the strainer to the side surface of the drum and to hold the backing plate 8 flush against the bracket 3.

A lever 1 is pivotably attached to the bracket 3. A hole 18 is located at the lower portion of the lever 1 to rotatably receive a pin 19, or rivet, which also extends through a second hole 17 located near the lower portion of the bracket 3. At or near the mid portion of the lever 1 a second pin 11 extends through the lever 1 rearward through a slot 16, in bracket 3, and forward to support a cam roller 10. The upper portion of the lever is provided with a stylus 2 extending through the lever 1 rearward towards the backing plate 8. The stylus 2 has a spring biased ball bearing or detent 2' which extends rearward toward and engages the exposed surface of the backing plate 8. As the lever pivots about pin 19 the stylus moves in an arc. The exposed surface of the backing plate 8 has several recesses 9 arranged in an arc corresponding to the arc travelled by the stylus 2 when lever 1 is pivoted. As the stylus passes over a recess 9 the biased ball bearing engages the recess 9 and provides a positive stop. This action also generates a faint clicking noise to inform the musician that a secured lever position has been attained. The embodiment described herein comprises four (4) recesses to provide four discrete strainer positions. However, it should be understood that any number of recesses can be used to achieve any number of desired intermediate positions.

A slider assembly 25 is vertically and slidably attached to the bracket 3. The bracket 3 has a pair of inwardly extending walls 13 having a wide portion **14*b* and a thin portion 14*a*. The slider assembly has an upper slider member 5, a lower slider member 4 and a tension bolt 7. The upper slider member 5 has two slots 5*b* each of which envelop both thin portion 14*a* and wide portion 14*b* of one corresponding inwardly extending wall 13. The upper slider 5 member also has a downwardly extending wall lying flush against the inside surface of wide portion 14*b* of the inwardly extending walls 13. The lower slider member 4 has slots 4*b* located on each side to envelop the thin portion 14*a* of a corresponding inwardly extending wall 13. The slots 5*b* located on each side of the upper slider member 5 are sufficiently wide to allow the lower slider member to overlap the downwardly extending wall 5*d* of the upper slider member 5**.

The lower slider member 4 has a clamp assembly 20 to attach the snares 27 to the strainer. A clamp 22 is secured to the lower portion of the lower slider member by screws 23. The lower slider member has a clamp support portion 21 which is bent inward towards the side of the drum. This inward geometry pulls the snares at a near vertical angle permitting improved snare drum sensitivity and less snare rattle. The clamp support portion 21 has two threaded bores which threadably receive screws 23. Clamp 22 has two holes corresponding to the two bores of the lower slider assembly. To secure the snares 27 to the lower slider member 4, snares are pulled across the clamp support 21, clamp 22 is placed adjacent to the clamp support 21 and the two screws are inserted into the holes to engaged the threaded bores in the clamp support 21. The screws are then tightened and the snares 27 are secure.

Upper slider member 5 is provided with a bore **5*a* which is capable of rotatably receiving an tension bolt 7 but will not allow the bolt 7 to move axially. Lower slider member 4 is provided with a bore 4*a* capably of threadably receiving the tension bolt 7. When the upper slider member 5 and lower slider member 4 are slidably attached to the bracket 3 the bores 5*a* and 4*a* are coaxially aligned. The tension bolt 7 is inserted through bore 4*a* and is free to rotate and threadably engages bore 5*a*. Tension bolt 7 is provided with a tension knob 6. When the tension knob 6 is turned, the tension bolt 7 engages bore 4*a* and causes upper slider member 4 and lower slider member 5 to move either towards or away from one another depending on the direction the tension knob 6 is rotated. This action enables fine adjustment of the length of the slider assembly 25** thus allowing a fine adjustment of the tension in the snare drums.

The downwardly extending wall **5*d* of the upper slider member 5 has a cam groove 5*c* to receive cam roller 10. As the lever 1 is rotated about rivet 19, the cam roller 10 travels through the cam groove 5*c* engaging the downwardly extending wall 5*d* causing the slider member 5 to either move upward or downward depending on the direction the lever 1 is pivoted. The cam groove profile 5*c* is such that when the stylus engages the first recess 9 (left most recess shown in FIG. 1) of the backing plate the upper slider member 5 is in a most upward position. As the lever 1 is shifted and the biased ball bearing in stylus 2 engages successive recesses 9, the slider assembly moves downward slightly. When the lever is pivoted and the stylus 2 engages the last recess (right most recess shown in FIG. 1**) the slider assembly is at the most lower position. When the slider member is in the most lower position the drum snares do not contact the bottom surface of the drum.

The operation and adjustment of the instant invention will now be explained. Once the strainer is attached to the side surface of a snare drum the lever 1 is pivoted to the right so that the entire slider assembly 25 is in it's lowermost position. The tension knob 6 is then turned so that the lower slider member 4 and clamp assembly 20 are at their lowermost position. The snares 27 are then clamped to the lower slider member 4, as discusses above, so that the snares 27 do not contact the bottom surface of the drum. The lever 1 is then pivoted to the left so that the slider assembly is in it most upward position. The snares will now engage the bottom surface of the drum 28 to give the distinct snare sound when the drum is played. The drummer may quickly and easily release some of the tension in the snares by pivoting the lever 1 so that the stylus engages the next recess 9. This affords a drummer the opportunity to quickly change the snare action or response of the snares to several predetermined positions within a range corresponding to the amount of tension that can be increases or decreased by movement of the lever 1. The drummer can increase the overall range of the snare action by turning the adjustment knob 6 to thereby fine-tune the snare action. The lever 1 is simply moved to the right so that the slider assembly 25 is lowered removing the snares from contact with the bottom surface of the drum. The tension knob is then turned to contract the slider assembly 25 such that the lower slider assembly 4, and the clamp assembly 20 is moved upward to increase the tension in the snares. The lever 1 is then moved to the left most position and the overall action or response that the snare drums can be adjusted to has increased. The drummer can then quickly adjust the action of the drums snares to several predetermined positions within this range by simply shifting lever 1. This overall drum snare strainer assembly affords the drummer both the opportunity for fine adjustment of the snare action before playing the instrument and the ability to quickly adjust the action within this set range during a performance. The drummer simply shifts the lever 1 right or left such that the stylus 2 engages a recess 9 corresponding to the desired snare action.

While the snare drum strainer of this invention has been shown and described with reference to a particular embodiment, it will be understood to those possessing skill in the art that various changes to the form and detail may be made therein without departing from the spirit and scope of the invention.

What is claimed is:

1. A snare drum strainer for adjusting the tension of snares extending across a head of a snare drum shell comprising;

a tensioning means to apply tension to said snares;

a lever having a lower end and an upper end, said lever being pivotably mounted to said tensioning means at its lower end, whereby pivoting said lever variably changes the position of said tensioning means to change the tension in said snare; and a locking means to selectively lock said lever in one of a plurality of predetermined snare engagement positions and a snare released position to allow a drummer to quickly adjust the tension of said snares during a performance.

2. A snare drum strainer as described in claim 1, wherein: said locking means include;

a backing plate mounted to said drum, said backing plate having a plurality of recesses arranged in an arc, a stylus mounted on said lever extending toward said backing plate, such that when said lever is rotated, said stylus is capable of engaging any of said recesses to secure said lever in one of said plurality of predetermined positions.

3. A snare drum strainer as described in claim 1, wherein said plurality of predetermined snare engagement positions includes at least two intermediate positions to progressively reduce the tension of said snares while maintaining contact with said drum shell.

4. A snare drum strainer as described in claim 1, said locking means further comprising:

a means to generate a faint noise when said lever is shifted to one of said plurality of predetermined snare engagement positions and snare released position.

5. A snare drum strainer for adjusting the tension of snares extending across a head of a snare drum shell comprising;

a tensioning means to apply tension to said snares;

a lever having a lower end and an upper end, said lever being pivotably mounted to said tensioning means at its lower end, whereby pivoting said lever variably changes the position of said tensioning means to change the tension in said snare; and a locking means to selectively lock said lever in a plurality of predetermined positions, wherein;

said locking means include;

a backing plate mounted to said drum, said backing plate having a plurality of recesses arranged in an arc, a stylus mounted on said lever extending toward said backing plate, such that when said lever is rotated, said stylus is capable of engaging any of said recesses to secure said lever in one of said plurality of predetermined positions, and said stylus includes;

a bearing means for engaging said plurality of recesses; and a resilient means for biasing said bearing means towards said backing plate to engage one of said recesses.

6. A snare drum strainer as described in claim 5, wherein said tensioning means comprise:

a backing plate mounted to an external surface of said drum shell;

a bracket mounted to said backing plate, wherein said bracket pivotably supports said lever;

a slider assembly vertically and slidably mounted to said bracket, wherein vertically is defined by a direction lying perpendicular to a plane defined by said head of said snare drum, said slider assembly having;

a clamp means to clamp said snares to said slider assembly.

7. A snare drum strainer as described in claim 6 wherein, said clamp means includes;

a clamp support extending toward said external surface of said drum shell, such that said snares extend downward from said clamp means in a substantially vertical direction.

8. A snare drum strainer as described in claim 6, wherein; said slider assembly includes;

an upper slider member having a bore extending therethrough;

a lower slider member having a threaded bore extending therethrough;

a tensioning bolt which extends through said upper slider member and rotatably supported thereto, said tensioning bolt threadably engaging said threaded bore of said lower slider member wherein, when said tensioning bolt is turned, said lower slider member is moved either towards or away from said upper slider member depending on the direction said tensioning bolt is turned.

9. A snare drum strainer as described in claim 6, wherein;

said bracket further comprises;

two inwardly extending walls lying in the same plane, each of said inwardly extending walls having a wide portion and a thin portion, each of said thin portions positioned more inward than said wide portions with a gap existing therebetween;

said lower slider member having a pair of opposing sides each provided with a slot, each of which envelop said thin portion of a corresponding inwardly extending wall;

said upper slider member having;

a downwardly extending wall lying flush against the inside surface of each wide portion of said inwardly extending walls; and a pair of opposing sides each provided with a slot each of which envelop both said thin portion and said wide portion of a corresponding inwardly extending wall;

wherein each of said slots of said upper slider member being of sufficient width to allow said lower slider member to overlap the downwardly extending wall of said upper slider member; and said upper and lower slider members slidingly engaging said bracket within said gap.

10. A snare drum strainer as described in claim 9 wherein;

said lever further comprises a pin located between said upper and lower end to rotatably support a cam roller; and said downwardly extending wall of said upper slider member has a cam groove capable of receiving said cam roller wherein, when said lever is pivoted, said cam roller rotates and engages said cam groove causing said upper slider member to vertically slide along said bracket.

11. A snare drum strainer as described in claim 5, wherein; said bearing means comprising a ball bearing; and said resilient means comprising a spring;

Wherein, when said ball bearing engages said recess a faint noise is generated.

12. A snare drum strainer for adjusting the tension of snares extending across a head of a snare drum shell comprising;

a backing plate mounted to said drum, said backing plate having a plurality of recesses arranged in an arc a bracket mounted to said backing plate having;

two inwardly extending walls lying in the same plane, each of said inwardly extending walls having a wide portion and a thin portion, each of said thin portions positioned more inward than said wide portions with a gap existing therebetween;

a lever having a lower end and an upper end, pivotably mounted to said bracket, said lever further comprising;

a stylus mounted on said lever extending rearward toward said backing plate, said stylus having;

a ball bearing; and a spring which biases said ball bearing towards said backing plate to engage one of said recesses, such that, when said ball bearing engages one of said recesses said lever is prevented from further rotation; and a pin located between said upper and lower end to support a cam roller;

a slider assembly vertically and slidably mounted to said bracket, wherein vertically is defined by a direction lying perpendicular to a plane defined by said head of said snare drum, said slider assembly having;

an upper slider member having a bore extending therethrough;

a lower slider member having a threaded bore extending therethrough;

a tensioning bolt which extends through said upper slider member and rotatably supported thereto, said tensioning bolt threadably engaging said threaded bore of said lower slider member wherein, when said tensioning bolt is turned, said lower slider member is moved either towards or away from said upper slider member depending on the direction said tensioning bolt is turned;

said lower slider member having a pair of opposing sides each provided with a slot, each of which envelop said thin portion of a corresponding inwardly extending wall, and a clamp support extending toward said external surface of said drum shell, such that said snares extend downward from said clamp means in a substantially vertical direction said upper slider member having;

a downwardly extending wall lying flush against the inside surface of each wide portion of said inwardly extending walls having a cam groove capable or receiving said cam roller wherein, when said lever is pivoted, said cam roller engages said cam groove causing said upper slider member to vertically slide along said bracket; and a pair of opposing sides each provided with a slot each of which envelop both said thin portion and said wide portion of a corresponding inwardly extending wall;

wherein each of said slots of said upper slider member being of sufficient width to allow said lower slider member to overlap the downwardly extending wall of said upper slider member; and said upper and lower slider members slidingly engaging said bracket within said gap.

* * * * *